US005778567A

United States Patent [19]

Jager et al.

[11] Patent Number: 5,778,567

[45] Date of Patent: Jul. 14, 1998

[54] MOUNTING ASSEMBLY FOR LIGHT DUTY SNOW PLOW

[75] Inventors: Willem Jager, Breslaw; Roland Peter Barth, Waterloo; Craig Shoemaker, Elora, all of Canada

[73] Assignee: Snowbear Corporation, Guelph, Canada

[21] Appl. No.: 641,613

[22] Filed: May 1, 1996

[30] Foreign Application Priority Data

Mar. 29, 1996 [CA] Canada ..... 2173025

[51] Int. Cl.[6] ..... E01H 5/04

[52] U.S. Cl. ..... 37/235; 37/231; 172/272

[58] Field of Search ..... 37/232, 231, 234, 37/235, 236, 240; 172/684.5, 439, 445.1, 450, 272, 810; 280/186, 456.1, 457, 458, 461.1; 56/10.4

[56] References Cited

U.S. PATENT DOCUMENTS

| | | | |
|---|---|---|---|
| 1,957,103 | 5/1934 | Frink . | |
| 2,166,424 | 7/1939 | Coates | 37/232 X |
| 2,703,244 | 3/1955 | Nearing | 37/231 X |
| 4,403,432 | 9/1983 | Biance | 37/235 |
| 4,439,939 | 4/1984 | Blau . | |
| 4,565,018 | 1/1986 | Oya | 37/232 |
| 4,821,435 | 4/1989 | Pester | 37/231 |
| 4,821,436 | 4/1989 | Solcum | 37/235 |
| 4,991,323 | 2/1991 | Benkler | 37/231 X |
| 5,014,961 | 5/1991 | Ferguson | 37/231 X |
| 5,037,121 | 8/1991 | Gallatin | 280/426 |
| 5,081,775 | 1/1992 | Veilleux | 37/231 X |
| 5,129,170 | 7/1992 | Fusilli | 37/231 |
| 5,364,117 | 11/1994 | Keith | 280/459 |
| 5,588,232 | 12/1996 | Renwick | 172/684.5 X |

*Primary Examiner*—Terry Lee Melius
*Assistant Examiner*—Victor Batson
*Attorney, Agent, or Firm*—Riches, McKenzie & Herbert

[57] ABSTRACT

A universal mounting assembly for a light duty snow plow using a lower triangular frame, an upper triangular frame and a pair of spaced-apart rearwardly directed tubular members for attaching the lower triangular frame to a vehicle. The mounting assembly can be secured to a vehicle using a quick release mechanism regardless of the vehicles ground clearance. Additionally, the plow can be used in any one of a plurality of predetermined positions with the bottom edge of the snow plow blade remaining substantially flat against the surface to be plowed. An electric winch that is supplied power from the battery of the vehicle to which the snow plow is mounted, is used to raise and lower the snow plow.

16 Claims, 5 Drawing Sheets

MOUNTING ASSEMBLY FOR LIGHT DUTY SNOW PLOW

TECHNICAL FIELD

The present invention relates to snow removal equipment, and in particular to snow plows for light duty vehicles such as pickup trucks, vans and sport utility vehicles.

BACKGROUND OF THE INVENTION

Snow removal has posed a problem for as long as motorized vehicles have been used for transportation. In response to the problem of removing significant quantities of snow from roadways, driveways and parking lots, many snow plowing arrangements have been invented. Many of the snow plows known from the prior art are specialized units specifically designed and constructed for a particular model of large vehicle. Normally, they include hydraulic cylinders for orienting the snow plow blade as well as for raising and lowering a blade to and from a plowing position. These large plows may also include "side wings" for pushing back banks of snow accumulated along an edge of a roadway.

Snow plows designed for light duty or "personal" vehicles are also known. For example, U.S. Pat. No. 1,957,103 entitled SNOW PLOW issued to C. H. Frink on May 1, 1934. This patent teaches a light duty snow plow having a fixed orientation for pushing snow to a right side of the vehicle. The snow plow is raised and lowered by a hand winch mounted to the top of a frame that bolts to a front of the vehicle.

U.S. Pat. No. 4,439,939 entitled SNOW PLOW issued Apr. 3, 1984 to Blau. This patent teaches a snow plow especially suitable for use with small vehicles, such as cars. The snow plow features a hydraulic system for controlling movement of the plow from side to side as well as for raising and lowering the plow. The snow plow also features a coupling system which permits the plow to be quickly coupled to the vehicle for snow plowing and quickly decoupled when the vehicle is to be used for conventional purposes. One disadvantage of this snow plow is that it requires an expensive hydraulic system which includes a pump driven by an electric motor powered by the car's electrical system. This greatly increases the expense of producing the plow. A further disadvantage is that the system for rotatably mounting the snow plow blade consists of a semi-circular swivel plate welded to the back of the blade. This blade orientation arrangement is common for prior art snow plows. The arrangement works well provided that the plow is designed and constructed for a vehicle having a specific road clearance. The semi-circular swivel plate is not adapted, however, to the production of a universal plow for use with different vehicles having a range of ground clearances. The problem with the semi-circular swivel plate is that unless the swivel plate is in a parallel relationship with a surface to be plowed when the plow is mounted to a vehicle, it causes the snow plow blade to be canted at an angle to the surface to be plowed if the plow is swivelled to push snow to either side of the vehicle. This canting effect causes one corner of the blade to dig into the surface to be plowed while the opposite corner is cantilevered above the surface to be plowed and snow is left behind on that side of the plow. The plow blade canting effect of the blade is well known and it has inhibited the development of a universal snow plow that swivels for pushing snow to either side of a vehicle, which is often desirable for clearing driveways to one side or for clearing parking lots and the like.

It is therefore a primary object of the present invention to provide a universal mounting assembly for a snow plow which may be mounted to practically any light duty vehicle regardless of the ground clearance of that vehicle.

It is a further object of the invention to provide a universal, personal snow plow which is inexpensive to manufacture.

It is yet a further object of the invention to provide a universal, personal snow plow which is quickly disconnected from a vehicle and readily stored when not in use.

SUMMARY OF THE INVENTION

In a first aspect of the invention, there is provided a universal mounting assembly for a light duty snow plow, comprising:

a lower triangular frame having a wide end for attachment to a vehicle and narrow end for the attachment of an upper triangular frame, the wide end including means for locking the snow plow in one of a plurality of predetermined positions for plowing snow, and the narrow end including a pivot point upwardly offset from a plane of the lower frame;

the upper triangular frame having a wide end for attachment to the snow plow and a narrow end for selective connection with the means for locking the snow plow into one of the plurality of predetermined positions for plowing snow, a center of the wide end being rotatably attachable to the pivot point of the lower triangular frame; and means for attaching the lower frame to a vehicle;

whereby, the mounting assembly can be secured to a vehicle regardless of its ground clearance, and the plow can be used in any one of the plurality of predetermined positions; and, a bottom edge of a blade of the snow plow remains substantially flat against a surface to be plowed regardless of the predetermined position selected for the plow.

In accordance with a further aspect of the invention, there is further provided a light duty snow plow for a personal vehicle such as a pickup truck, van or sport utility vehicle, comprising:

a snow plow mounting frame affixed to at least two points on a frame of the vehicle, the snow plow mounting frame including at least one cross member generally aligned with a front of the vehicle, the cross member supporting at least two spaced-apart forwardly extending pins for mounting the snow plow to the vehicle;

a V-shaped winch frame, the free ends of the V-shaped winch frame having tubular connectors affixed thereto, the tubular connectors being oriented to receive the forwardly extending pins, and a narrow end of the V-shaped winch frame being outwardly and upwardly directed when the pins are received in the tubular connectors, and the narrow end is adapted to support a winch for raising and lowering the snow plow;

a lower triangular frame having a wide end pivotally attached to the ends of the V-shaped winch frame, and a narrow end for the attachment of an upper triangular frame, the wide end including means for locking the snow plow in a one of a plurality of predetermined positions for plowing snow, and the narrow end including a pivot point upwardly offset from a plane of the lower frame;

an upper triangular frame having a wide end for attachment to the snow plow and a narrow end for selective connection with the means for locking the snow plow in a one of the plurality of predetermined positions for plowing snow, a center of the wide end being rotatably attachable to the pivot point of the lower triangular frame;

a snow plow blade pivotally attached to the wide end of the upper triangular frame; and means for inhibiting the snow plow blade from pivotal movement during normal use.

The invention therefore provides a universal mounting assembly for a light duty snow plow which is adapted to be used with practically any light duty vehicle such as a pickup truck, van or sport utility vehicle, regardless of the ground clearance of the vehicle. This is accomplished by providing a mounting assembly that permits a snow plow to be used in any plowing orientation regardless of the ground clearance of the vehicle to which it is attached. The unique mounting assembly includes a lower triangular frame having a wide end that attaches to the vehicle and a narrow end that is provided with an upwardly offset swivel which supports an upper triangular frame that attaches to a rear side of the snow plow blade. The upper and lower frames are interconnected on a rear side by an elongated locking plate shaped in a circular arc complementary with an arc of the movement of the narrow end of the upper triangular frame. On the front side, the upper and lower frames are interconnected at the upwardly offset pivot of the lower frame. This mounting assembly permits the blade to be positioned at any predetermined angle useful for plowing snow to either side of the vehicle, while ensuring that the bottom edge of the blade remains level and in full contact with the surface to be plowed. The universal mounting frame eliminates the problem of ensuring that the mounting assembly for a snow plow is parallel with the ground when the snow plow is attached to the vehicle and the plow is in the plowing position.

The vehicle component of the quick-disconnect hookup for the universal mounting assembly includes at least a pair of brackets which bolt to the frame of the vehicle. Each vehicle component is especially adapted to be compatible with the vehicle frame. The vehicle component of the quick-disconnect mounting assembly is also adapted to fit as closely to the underside of the vehicle body as practical so that it does not appreciably decrease the ground clearance of the vehicle and is not unsightly.

BRIEF DESCRIPTION OF THE DRAWINGS

The invention will now be explained in more detail by way of example only and with reference to the following drawings, wherein.

DETAILED DESCRIPTION OF THE PREFERRED EMBODIMENT

Figure 1:
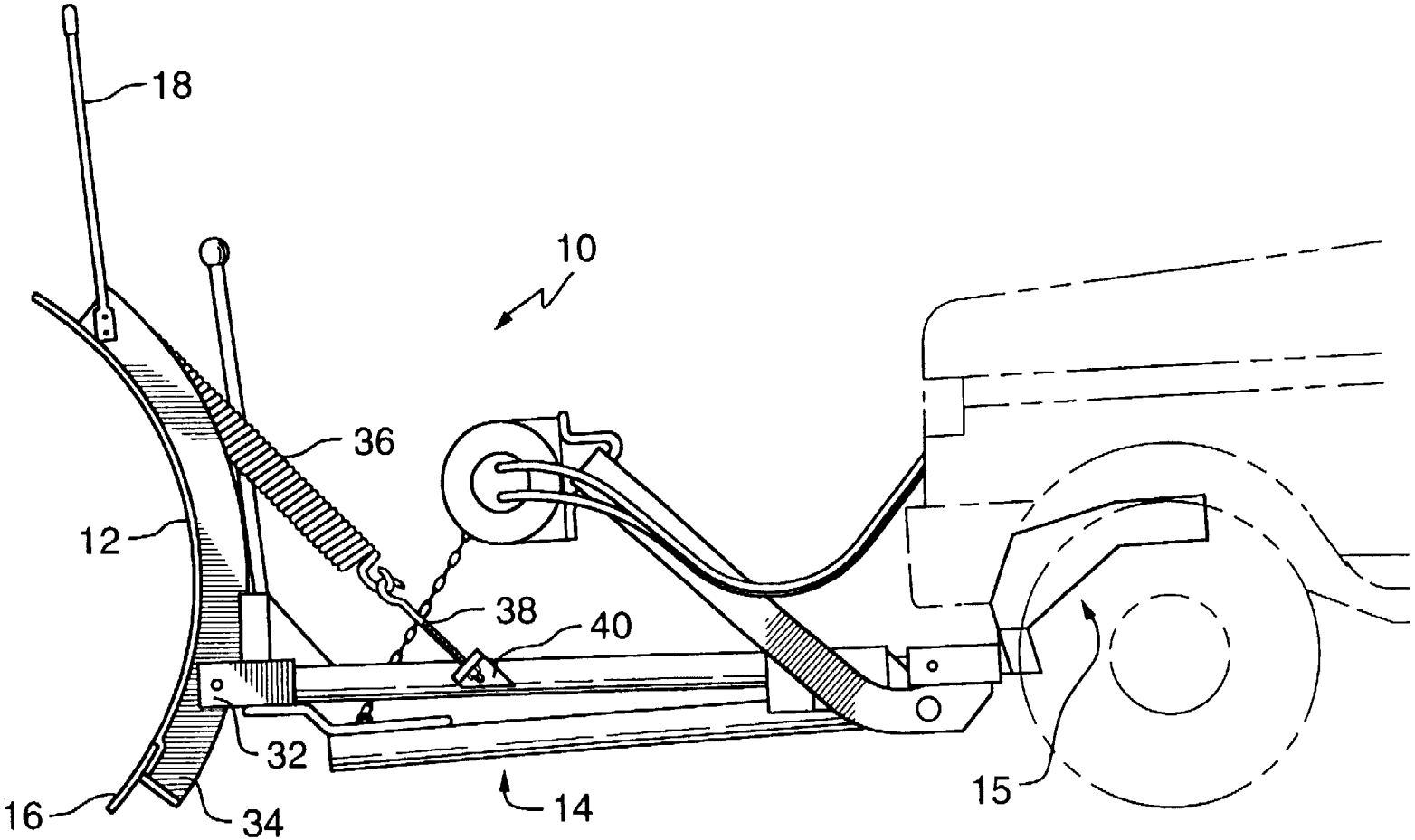
FIG. 1 is a side elevational view of a snow plow in accordance with the invention mounted to a light duty vehicle such as a pickup truck.

FIG. 1 shows a side elevational view of a snow plow for light duty vehicles in accordance with the invention mounted to a pickup truck shown in ghost lines. The snow plow generally indicated by the reference 10 includes a snow plow blade 12 and a universal mounting assembly generally indicated by the reference 14. Attached to the vehicle is a vehicle mount component, generally indicated by the reference 15. The structure of the vehicle mount component 15 is described below in detail with reference to FIG. 4.

Figure 2:
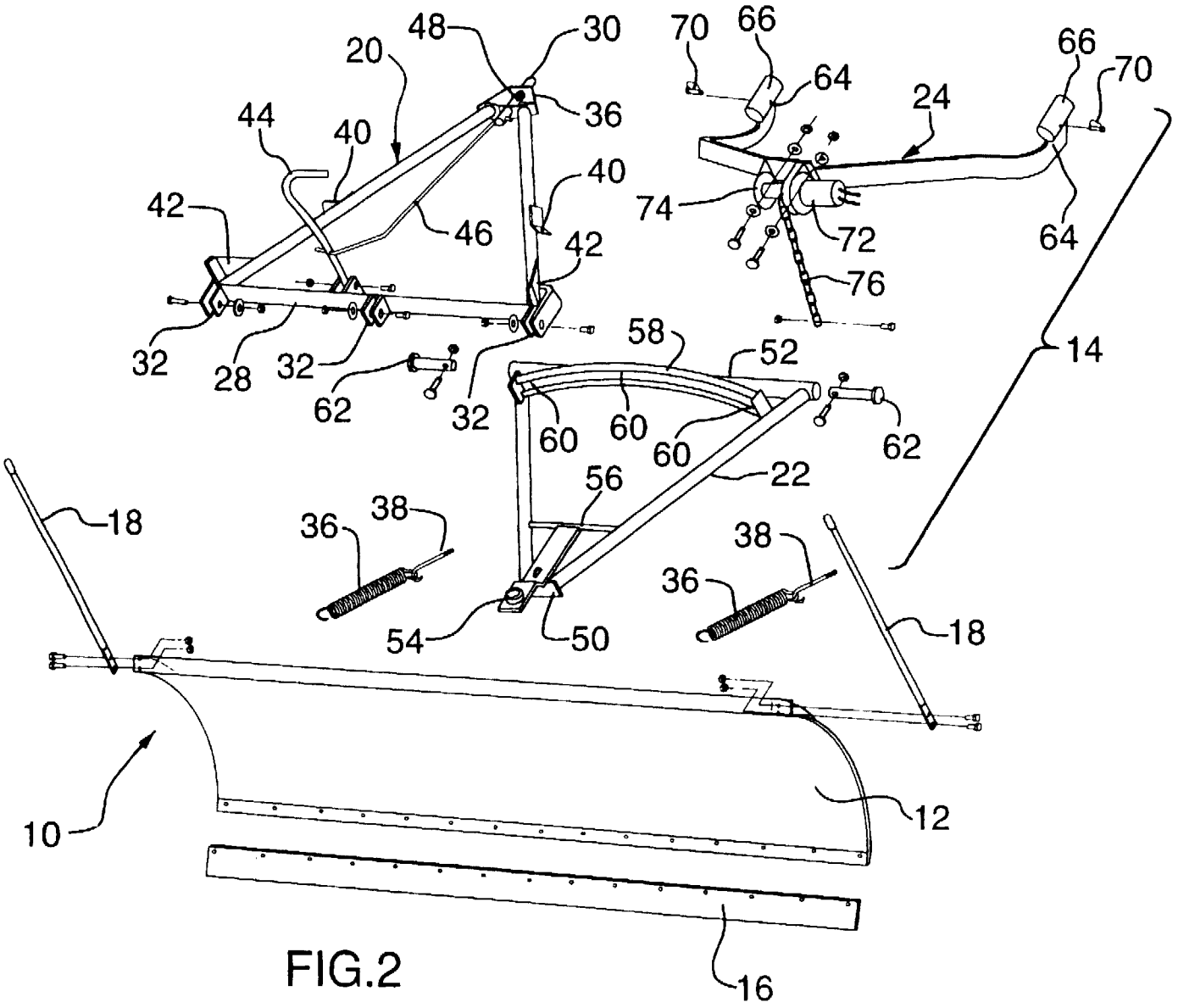
FIG. 2 is an exploded view of the snow plow blade and the universal mounting assembly in accordance with the invention.

FIG. 2 shows an exploded view of the snow plow 10 in accordance with the invention. The snow plow blade 12 preferably includes a detachable scraper 16 which is bolted to a bottom edge of the blade 12 so that it may be replaced when worn. The blade 12 may be any typical snow plow blade, which is forwardly curved in a circular arc to force the plow against the surface to be plowed and to roll snow ahead of the vehicle until it is displaced to a side of the vehicle. The snow plow blade 12 is preferably about 24" (61 cm) in height and is typically constructed in a circular arc having a radius of curvature of about 15" (38 cm). The blade preferably includes edge indicators 18 which are bolted to opposite sides of the blade and extend well above the blade 12 to indicate the edge of the blade to facilitate an operator in avoiding obstacles because the blade is often not visible if deep powder snow is being plowed.

The universal mounting assembly 14 for connecting the snow plow blade 12 to a light duty vehicle includes an upper triangular frame 20, a lower triangular frame 22 and a V-shaped winch frame 24. The upper triangular frame 20 includes a narrow end 26 and a wide end 28, the narrow end 26 including a biased locking pin 30 for locking the snow plow blade 12 in one of a plurality of positions for plowing snow, as will be explained in more detail in relation to FIG. 3. The wide end 28 of the upper triangular frame includes a plurality of forwardly extending mounting brackets 32 which are pivotally connected to reinforcing ribs 34 welded to a rear side of the blade (see FIG. 1). The mounting brackets 32 permit the blade to swivel forwardly if the scraper 16 strikes an immovable object during snow plowing. The snow plow blade 12 is biased to an upright position by the tension of two coil springs 36 which attach on one end to a longitudinal reinforcing rib that extends along a top of the blade, and on another end to anchor hooks 38 which are in turn mounted to mounting brackets 40. The snow plow blade 12 is prevented from pivoting rearwardly from the plowing position by a pair of retainer brackets 42 welded to a top edge of the wide end of the upper triangular frame 20. The opposite side members of the upper triangular frame 20 may be constructed from tubular steel or angle iron. They must be rigid enough to withstand the stress of plowing snow. The wide end 28 of the upper triangular frame is preferably constructed from a heavy gauge angle iron. The orientation of the snow plow blade 12 is adjusted using a blade orientation lever 44 which is connected to a blade orientation linkage 46 that is in turn connected to the biased locking pin 30. The biased locking pin 30 is urged to an extended, engaged position by a coil spring 48 which can be more clearly seen in FIG. 3.

The lower triangular frame 22 is similar to the upper triangular frame 20 but it is oriented in an opposite direction with respect to the snow plow blade 12. The lower triangular frame 22 includes a narrow end 50 and a wide end 52. Affixed to the narrow end 50 is an upwardly offset pivot 54 to which is pivotally attached the wide end 28 of the upper triangular frame 20. The upwardly offset pivot 54 is preferably offset at least 1" (2.5 cm) above a top surface of the lower triangular frame. The pivot is preferably constructed of a heavy gauge flat iron. It is affixed on a rear end to a cross brace 56 which lends rigidity to the lower triangular frame and prevents the upwardly offset pivot from being torn loose from its attachment to the front end 50 of the lower triangular frame 22. Affixed to a top surface of the wide end 52 of the lower triangular frame 22 is an elongated locking plate 58 having at least three locking apertures 60 for locking the snow plow blade 12 in a plurality of positions for directing snow moved by the blade. The apertures 60 receive the locking pin 30 attached to the narrow end 26 of the upper triangular frame 20. This permits the orientation of the snow plow blade 12 to be changed using the blade orientation lever 44, as will be explained in more detail with relation to FIG. 3.

The wide end 52 of the lower triangular frame 22 is pivotally attached by pivot pins 62 to the free ends of the V-shaped winch frame 24. Each free end of the winch frame 24 includes a pivot bore 64 for receiving the pivot pins 62. Affixed to the winch frame 24 above the pivot bores 64 are tubular mounting members 66 which slide over forwardly extending mounting pins 68 (see FIG. 4) affixed to the vehicle component of the snow plow 10. The tubular mounting members 66 are locked to the mounting pins 68 using quick-release hitch pins 70 in a manner well known in the art. The V-shaped winch frame 24 preferably is upwardly and forwardly inclined as, for example, at an angle of about 30 degrees from the horizontal. Mounted to the narrow end of the V-shaped winch frame 24 is an electric winch 72 that is connected by a flexible hauling member 76 to a rear end of the upwardly offset pivot 54 for raising and lowering the snow plow 10 from a plowing position. The flexible hauling member 76 is preferably a chain is attached to a drum 74 of the electric winch 72. The electric winch 72 is controlled by a typical winch control unit (not illustrated) which may be permanently mounted in the vehicle, or removably mounted in the vehicle using suction cups or the like in a manner well known in the art. The winch is connected to the vehicle battery and the winch control unit using quick-disconnect electrical connectors (not illustrated) also well known in the art.

Figure 3:
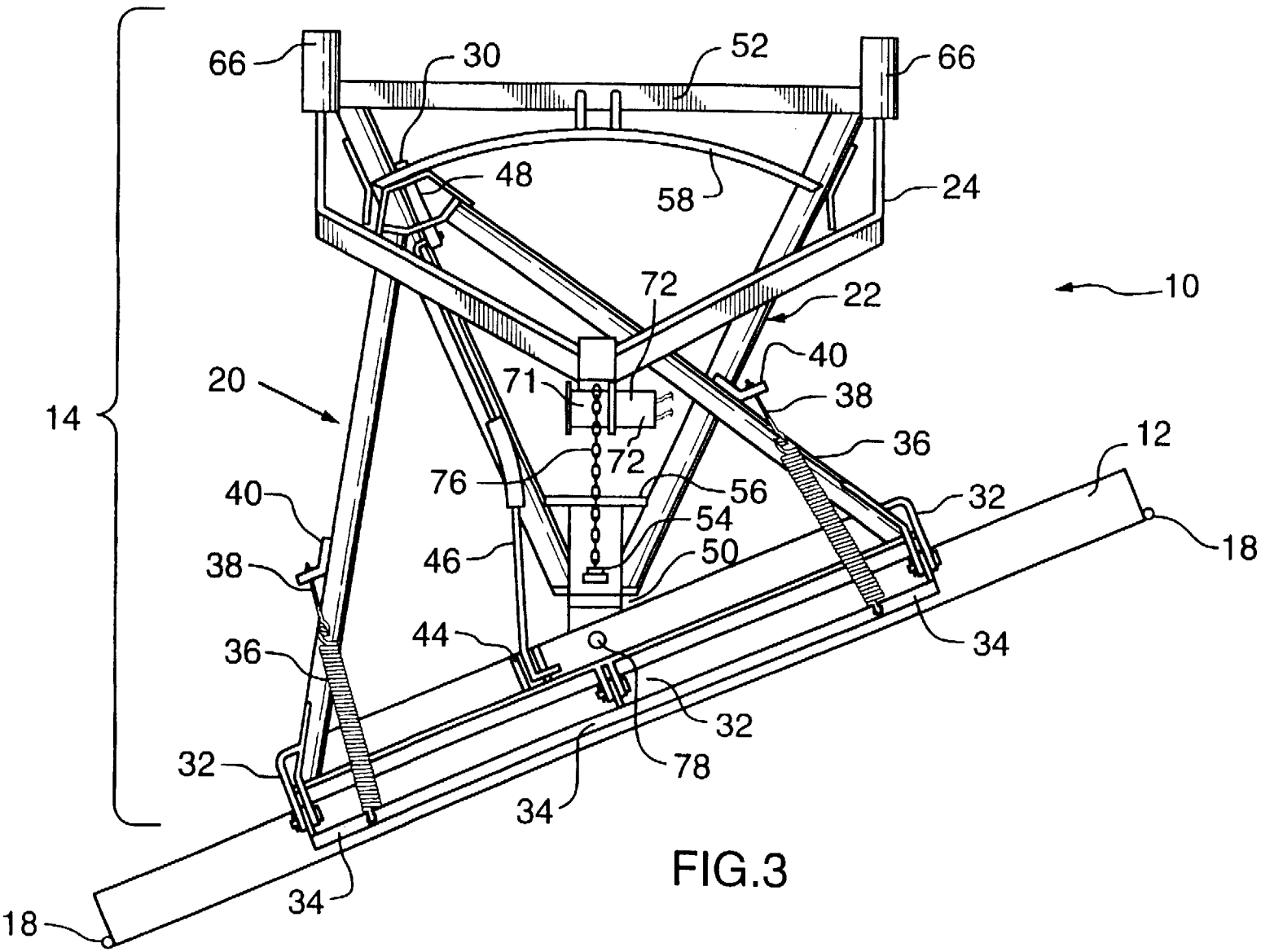
FIG. 3 is a top plan view of the snow plow shown in FIG. 1, the snow plow being oriented in a position to push snow to the left side of a vehicle to which it is mounted.

FIG. 3 shows a top plan view of a snow plow blade 12 attached to a universal mounting assembly 14 in accordance with the invention, the snow plow blade being oriented to push snow to a left side of a vehicle to which the snow plow is attached. As explained above, the orientation of the snow plow blade 12 is controlled using the blade orientation lever 44 which is attached to the locking pin 30 by a blade orientation linkage 46. When the blade orientation lever 44 is pulled forwardly towards a top of the snow plow blade 12, the force acts against the coil spring 48 to remove the locking pin 30 from its locking engagement with a locking aperture 60 (see FIG. 2). When the locking pin 30 is disengaged from a locking aperture 60, the blade may be manually swivelled to a new position which is predetermined by the location of the locking apertures 60. Preferably, the elongated locking plate 58 includes at least three locking apertures 60 which orient the blade 12 to move snow to the right, left, or straight ahead of the vehicle to which the snow plow 10 is attached. It is important to note that the combination of the upper and lower triangular frames permits the snow plow blade 12 to rest flat against a surface to be plowed regardless of the orientation of the blade and substantially regardless of the ground clearance of a vehicle to which the snow plow 10 is attached. This is a distinct advantage of the snow plow for light duty vehicles in accordance with the invention. Prior art snow plows adapted to permit the blade to be oriented to a plurality of plowing positions were typically constructed with a semi-circular swivel plate welded to the black of the blade. This blade orientation arrangement works well only when the plow is designed and constructed for a vehicle having a specific ground clearance because the semi-circular swivel plate must be oriented in a parallel relationship to the ground in order for the blade to remain flat against the ground when it is oriented in any position except parallel with the front of the vehicle. Prior art plows were therefore not adapted for use as universal plows for light duty vehicles. Because of the arrangement of the upper and lower triangular frames and the attachment of the upper frame to the lower frame, the upper frame is permitted to tilt sideways around pivot points provided by the locking pin 30 and the upwardly offset pivot 54. The upper triangular frame 20 is attached to the pivot point of the lower triangular frame 54 by a pivot pin 78. The pivot pin 78 is secured with a locking nut arrangement that leaves some freedom for the upper triangular frame to tilt sideways with respect to the lower triangular frame. This capacity for tilting the snow plow blade 12 with respect to the front of the vehicle permits the blade to be used while turned to either side even if the universal mounting assembly is not parallel with the ground. Thus, this mounting assembly may be used with a wide range of light duty vehicles having varying ground clearances, while permitting the snow plow blade 12 to be oriented in any one of a plurality of predetermined positions for plowing snow without the blade canting and one corner digging in.

Figure 4:
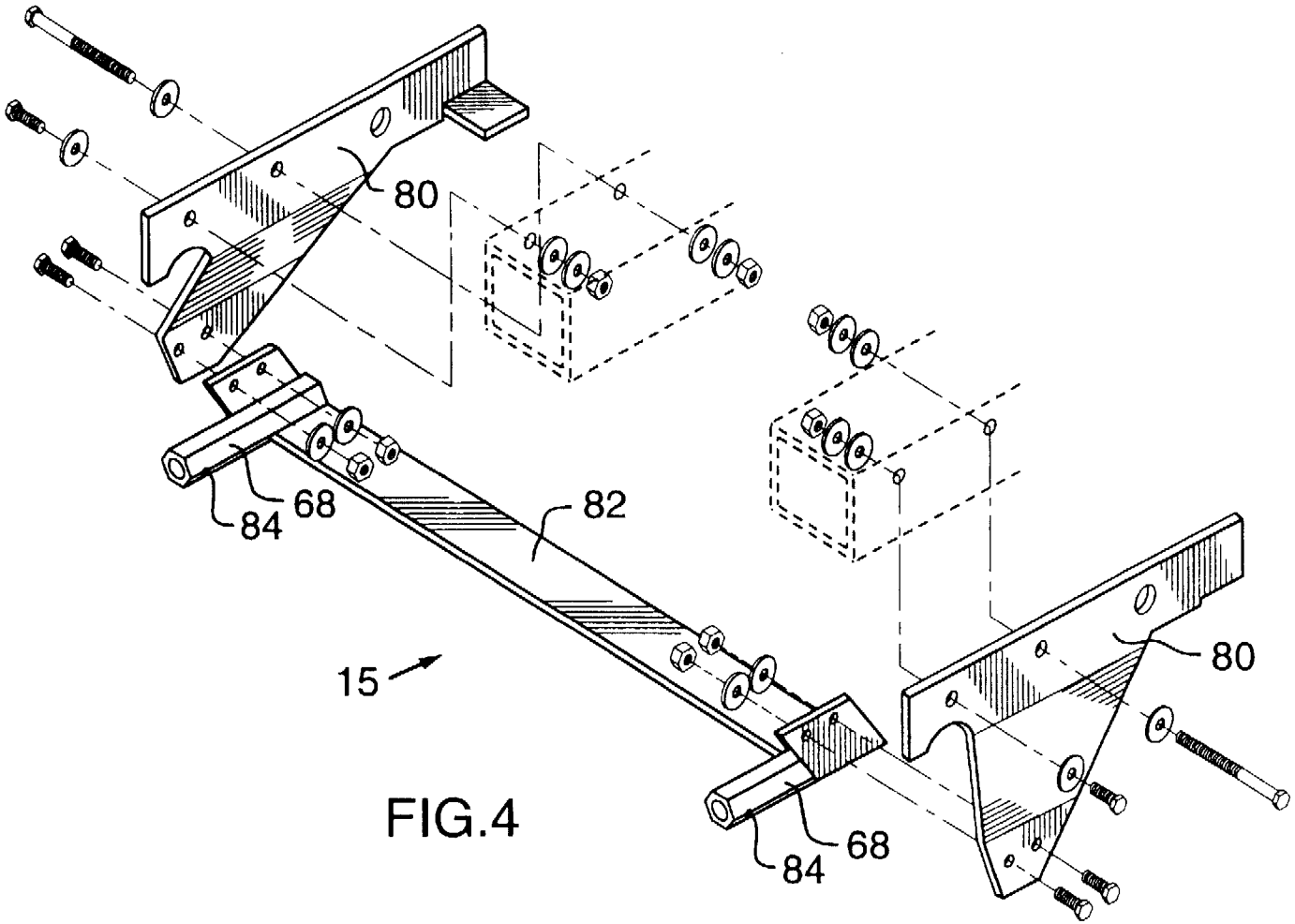
FIG. 4 is an exploded view of an exemplary vehicle component of the universal mounting assembly in accordance with the invention.

FIG. 4 shows an exemplary construction for the vehicle component 15 of the universal mounting assembly. A primary concern in designing the vehicle component 15 was to ensure that the mounting pins 68 are as close to the bumper of the vehicle as practically possible in order to ensure that the vehicle component of the mounting assembly does not appreciably reduce the ground clearance of the vehicle and to ensure that the vehicle component 15 of the mounting assembly is unobtrusive when the snow plow 10 is not attached to the vehicle. The snow plow 10 is designed to be attached to the vehicle only at those times when there is snow to be plowed. At all other times, the snow plow 10 is stored on a special storage cart assembly as will be explained below with relation to FIG. 5. A vehicle component 15 of the mounting assembly is designed and constructed for each model of vehicle to which the snow plow 10 is to be attached so that it can be mounted to the vehicle using bolt fasteners only. This eliminates the requirement for any welding, shaping, or modification of the vehicle frame to accommodate the vehicle component 15 of the mounting assembly. While each vehicle component 15 of the mounting assembly is slightly different in shape and configuration, the mounting assembly shown in FIG. 4 is typical. It includes a pair of side brackets 80 used for bolting a mounting frame 82 to the vehicle. The mounting frame supports a pair of the forwardly extending mounting pins 68 which are precisely positioned to receive the open ends of the tubular mounting members 66. Each mounting pin 68 includes a radial bore 84 for accommodating the quick-release hitch pin 70 which locks the tubular mounting members 66 to the mounting pins 68. The mounting pins 68 are preferably a heavy gauge tubular steel construction but solid pins are equally acceptable. The vehicle component of the mounting assembly 15 is designed to be bolted to the vehicle and left in place while, as described above, the snow plow 10 is designed to be attached to the vehicle only when the plow is in use. The two-point attachment provided by the tubular mounting members 66 and the mounting pins 68 permits the snow plow 10 to be attached to and removed from the vehicle in less than 60 seconds using the storage cart assembly shown in FIG. 5.

Figure 5:
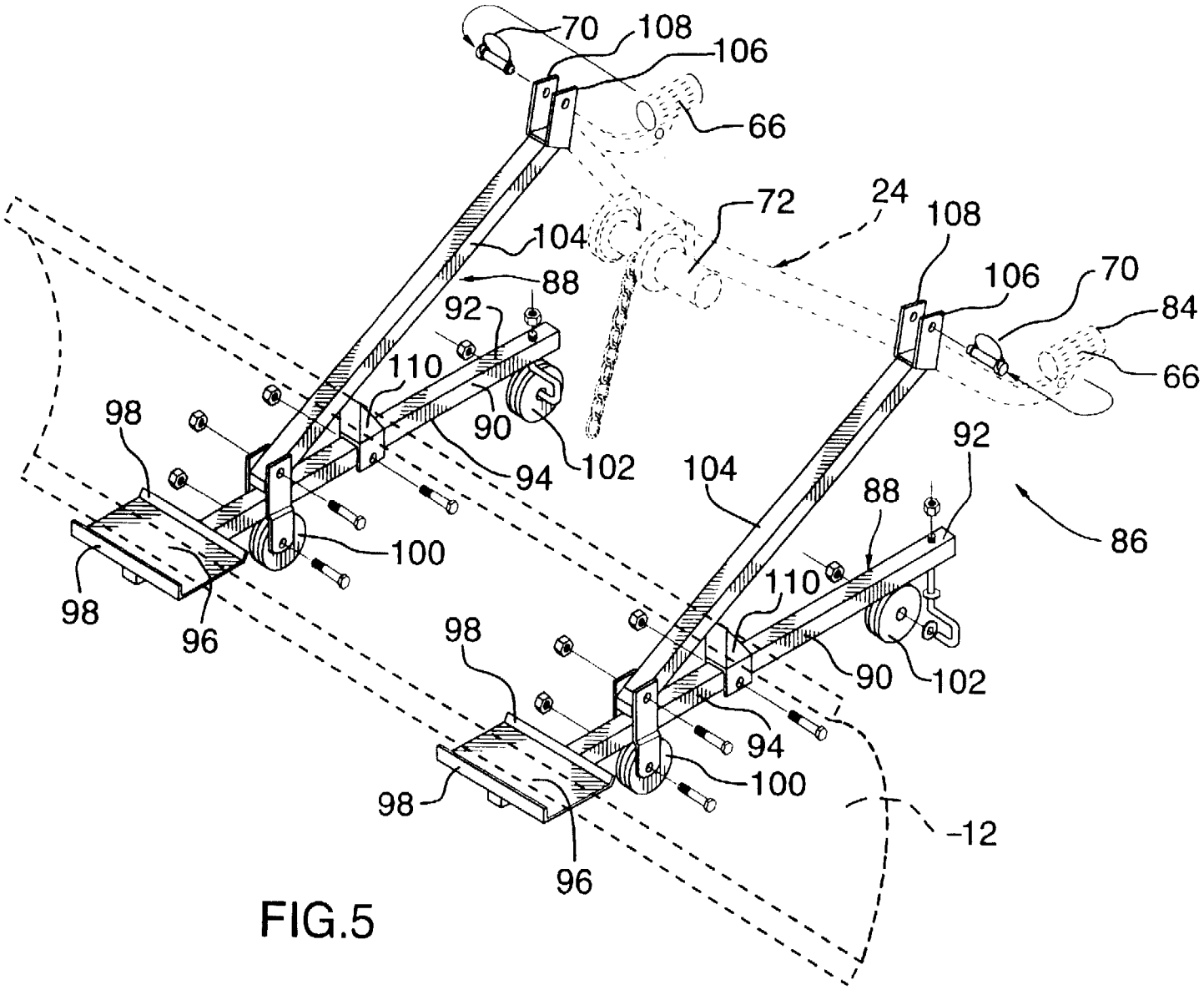
FIG. 5 is an exploded schematic view of a storage cart assembly for storing the snow plow in accordance with the invention.

FIG. 5 shows an exploded view of a mounting cart assembly in accordance with the invention, only a portion of the snow plow 10 being illustrated for the purpose of clarity. The mounting cart assembly, generally indicated by reference 86, includes a pair of independent adjustable frames 88. Each frame 88 includes a bottom member 90 having a top side 92 and a bottom side 94. Attached to a front end of the top side 92 is a plate 96 having upturned edges 98. The plate 96 is designed for supporting one side of the snow plow blade 12, shown in ghost lines. The upturned edges 98 prevent the snow plow blade 12 from sliding off the plates 96. Attached to the bottom side 94 of the bottom member 90 are two spaced apart wheels. The front wheel 100 is preferably a fixed wheel which rolls in a straight line. The rear wheel 102 is preferably attached to a swivel mount to permit the storage cart to be readily steered. The front wheel 100 is supported by a pair of brackets which extend above the top surface 92 of the lower member 90 to pivotally support an upper member 104. The upper member 104 has an upturned, U-shaped top end 106 which includes aligned bores 108 for receiving the quick-release hitch pins 70 that are moved from the radial bores 84 in the tubular mounting member 66 and the mounting pins 68 after the snow plow is supported by the storage cart assembly, to lock the storage cart assembly to the snow plow 10.

To use the storage cart assembly, the snow plow 10 is raised to an elevated position using the electric winch 72. An adjustable frame 88 is moved into position on each side of the snow plow 10 and the U-shaped top ends 106 of the upper members 104 is slid over the V-shaped winch frame in the position shown in FIG. 5. The electric winch is then operated to lower the snow plow blade onto the two plates 96 where it is supported. The quick-release hitch pins 70 are then removed from the tubular mounting members 66 and mounting pins 68 and slid through the aligned bores 108 in the U-shaped top ends 106 of the upper members 104 to lock the snow plow 10 to the storage cart assembly 86. In order to ensure that the snow plow 10 is supported in a position which permits a rapid recoupling of the snow plow 10 to the vehicle, each adjustable frame 88 is provided with an adjustable support block 110 which slides along the top surface 92 of the lower member 90 to support the upper member 104 in an appropriate position for retaining the winch frame 24 in the correct position. Before the snow plow is detached from the mounting pin 68 (not illustrated), the support blocks 110 are slid into position under the upper members 104 to ensure that they do not swing downwardly when the snow plow 10 is disconnected from the vehicle. Once the support blocks 110 are correctly positioned and secured, the snow plow 10 is wheeled away from the vehicle to a storage area. To remount the snow plow 10 to the vehicle, the vehicle is parked on a level surface and the storage cart assembly is rolled out and the tubular mounting members 66 are slid over the mounting pins 68. Thereafter, the quick-release hitch pins 70 are removed from the aligned bores 108 in the U-shaped top ends of the upper member 104 and slid through the aligned radial bores in the tubular mounting members 66 and the mounting pins 68. The electric winch 72 is then operated to raise the snow plow blade from the plates 96 and the adjustable frames are removed.

It is apparent that a novel universal mounting assembly for a snow plow has been disclosed, as well as a new and improved snow plow for light duty vehicles such as pickup trucks, vans and sport utility vehicles. Changes and modification to the described embodiment will be apparent to those skilled in the art. The scope of the invention is therefore intended to be limited solely by the scope of the appended claims.

We claim:

1. A universal mounting assembly for a light duty snow plow, comprising:

a lower triangular frame having a wide end for attachment to a vehicle and narrow end for the attachment of an upper triangular frame, the wide end including means for locking the snow plow in one of a plurality of predetermined positions for plowing snow, and the narrow end including a pivot point upwardly offset from a plane of the lower frame;

the upper triangular frame having a wide end for attachment to the snow plow and a narrow end for selective connection with the means for locking the snow plow into one of the plurality of predetermined positions for plowing snow, a center of the wide end being rotatably attachable to the pivot point of the lower triangular frame; and means for attaching the lower frame to a vehicle;

whereby, the mounting assembly can be secured to a vehicle regardless of its ground clearance, and the plow can be used in any one of the plurality of predetermined positions; and, a bottom edge of a blade of the snow plow remains substantially flat against a surface to be plowed regardless of the predetermined position selected for the plow.

2. A universal mounting assembly for a light duty snow plow as claimed in claim 1 wherein the means for attaching the lower frame to a vehicle comprises a pair of spaced-apart rearwardly directed tubular members pivotally attached to the wide end of the lower triangular frame, and a pair of spaced apart forwardly directed pins affixed to a frame attached to a front of the vehicle, the tubular members being adapted to be lockingly received on the pins to provide a quick release mechanism for attaching the snow plow to the vehicle.

3. A universal mounting assembly for a light duty snow plow as claimed in claim 2 wherein the tubular members are affixed to free ends of a V-shaped winch frame and opposite ends of the wide end of the lower frame are pivotally attached to adjacent points on the free ends of the V-shaped winch frame, the narrow end of the V-shaped winch frame being upwardly directed and adapted to support a winch for raising and lowering the snow plow.

4. A universal mounting assembly for a light duty snow plow as claimed in claim 3 wherein the winch is an electric winch that is supplied with operating power from a battery of the vehicle to which the snow plow is mounted.

5. A universal mounting assembly for a light duty snow plow as claimed in claim 1 wherein the means for locking the snow plow in a one of the plurality of predetermined positions for plowing snow comprises:

an elongated locking plate shaped in a circular arc complementary with an arc of movement of the narrow end of the upper triangular frame when the upper triangular frame is pivotally attached to the pivot point on the lower triangular frame, the locking plate being provided with a plurality of bores for receiving a pin reciprocally attached to the narrow end of the upper frame; and the locking plate is affixed to a top surface of the wide end of the lower triangular frame so that it contacts the narrow end of the upper triangular frame but permits the lower triangular frame to be pivoted within a limited range about the pivot point.

6. A universal mounting assembly for a light duty snow plow as claimed in claim 5 wherein the pin reciprocally attached to the narrow end of the upper triangular frame is biased by a spring to an extended position for engaging a one of the plurality of bores in the locking plate.

7. A universal mounting assembly for a light duty snow plow as claimed in claim 6 wherein the pin is reciprocated from an engaged position to an unengaged position by a manually operated lever connected to an end of the pin.

8. A universal mounting assembly for a light duty snow plow as claimed in claim 7 wherein the lever is pivotally attached to the wide end of the upper triangular frame and the pin is attached to the lever by a linkage rod.

9. A universal mounting assembly for a light duty snow plow as claimed in claim 3 wherein the winch for raising and lowering the snow plow is attached by a flexible hauling member to the narrow end of the lower frame at a point behind and adjacent the pivot point.

10. A universal mounting assembly for a light duty snow plow as claimed in claim 9 wherein the flexible hauling member is a length of chain.

11. A light duty snow plow for a vehicle comprising:

a snow plow mounting frame capable of being affixed to at least two points on a frame of the vehicle, the snow plow mounting frame including at least one cross member capable of being generally aligned with a front of the vehicle, the cross member supporting at least two spaced-apart forwardly extending pins for mounting the snow plow to the vehicle;

a V-shaped winch frame, the free ends of the V-shaped winch frame having tubular connectors affixed thereto, the tubular connectors being oriented to receive the forwardly extending pins, and a narrow end of the V-shaped winch frame being outwardly and upwardly directed when the pins are received in the tubular connectors, and the narrow end is adapted to support a winch for raising and lowering the snow plow;

a lower triangular frame having a wide end pivotally attached to the ends of the V-shaped winch frame, and a narrow end for the attachment of an upper triangular frame, the wide end including means for locking the snow plow in a one of a plurality of predetermined positions for plowing snow, and the narrow end including a pivot point upwardly offset from a plane of the lower frame;

an upper triangular frame having a wide end for attachment to the snow plow and a narrow end for selective connection with the means for locking the snow plow in a one of the plurality of predetermined positions for plowing snow, a center of the wide end being rotatably attachable to the pivot point of the lower triangular frame;

a snow plow blade pivotally attached to the wide end of the upper triangular frame; and means for inhibiting the snow plow blade from pivotal movement during normal use.

12. A light duty snow plow as claimed in claim 11, wherein the means for inhibiting the snow plow blade from pivotal movement during normal use comprises a pair of heavy coil springs respectively attached to a top of a rear side of the snow plow blade and a corresponding side of the upper triangular frame.

13. A light duty snow plow as claimed in claim 11 wherein the V-shaped winch frame is upwardly and forwardly inclined at an angle of about 30 from the horizontal.

14. A light duty snow plow as claimed in claim 11 wherein the winch for raising and lowering the snow plow is an electrically powered winch.

15. A light duty snow plow as claimed in claim 11 wherein the tubular connectors are attached to the pins using quick-lock hitch pins.

16. A light duty snow plow as claimed in claim 11 wherein the snow plow is further provided with a storage cart which comprises a first and second identical wheeled frame, each frame including a first member having a top side and a bottom side, the bottom side having first and second spaced-apart wheels attached thereto and an end of the top side includes a plate for supporting a bottom edge of the snow plow blade, and a second member pivotally attached to a top side of the first member, the second member having a free end for selective attachment to the V-shaped frame adjacent the tubular connectors; and means for locking the second member so that the free end is supported in a raised position;

whereby the free end of a one of the wheeled frames is attached to respective sides of the V-shaped frame while the snow plow blade is in a raised condition, the snow plow blade is lowered to rest on the plates, the second member is locked in its raised position, and thereafter the snow plow can be detached from the vehicle and wheeled to a storage site while the snow plow is not required to be used.

* * * * *